US009068324B2

(12) United States Patent
Linder et al.

(10) Patent No.: US 9,068,324 B2
(45) Date of Patent: Jun. 30, 2015

(54) BULLDOZER FOLDING BLADE

(71) Applicant: CNH AMERICA LLC, New Holland, PA (US)

(72) Inventors: Marvin L. Linder, Carman, IL (US); Jeffrey Torvinen, Burlington, IA (US); Katrina L. McClelland, Bowen, IL (US); Matthew D. Wagenbach, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 13/719,700

(22) Filed: Dec. 19, 2012

(65) Prior Publication Data

US 2014/0083725 A1 Mar. 27, 2014

Related U.S. Application Data

(60) Provisional application No. 61/706,488, filed on Sep. 27, 2012.

(51) Int. Cl.
*E01H 5/06* (2006.01)
*E02F 3/815* (2006.01)

(52) U.S. Cl.
CPC ..... *E02F 3/8155* (2013.01)

(58) Field of Classification Search
USPC ..... 37/274, 281, 266; 172/782, 811
See application file for complete search history.

(56) References Cited

U.S. PATENT DOCUMENTS

| | | | | | |
|---|---|---|---|---|---|
| 4,479,312 | A * | 10/1984 | Turgeon | 37/219 |
| 5,241,763 | A | 9/1993 | Dynan | |
| 5,411,102 | A * | 5/1995 | Nickels et al. | 172/781 |
| 5,638,618 | A * | 6/1997 | Niemela et al. | 37/281 |
| 5,655,318 | A | 8/1997 | Daniels | |
| 6,425,196 | B1 | 7/2002 | Weagley et al. | |
| 6,442,877 | B1 * | 9/2002 | Quenzi et al. | 37/281 |
| 6,877,258 | B2 * | 4/2005 | Frey | 37/281 |
| 6,883,436 | B2 * | 4/2005 | Fuerst | 104/7.3 |
| 7,360,327 | B2 * | 4/2008 | Osgood et al. | 37/444 |
| 7,530,184 | B2 | 5/2009 | Ishihama et al. | |
| 7,640,682 | B1 | 1/2010 | Buckbee | |

(Continued)

FOREIGN PATENT DOCUMENTS

| | | |
|---|---|---|
| JP | H10183673 | 7/1998 |
| JP | 2000096602 | 4/2000 |

(Continued)

*Primary Examiner* — Matthew D Troutman
(74) *Attorney, Agent, or Firm* — Patrick M. Sheldrake; Seyed V. Sharifi T.

(57) ABSTRACT

A bulldozer includes a folding blade that includes a base blade having opposed ends. A first blade portion is rotatably movable about an axis near one end of the base blade. A second blade portion is rotatably movable about an axis near an end of the base blade opposite the first blade portion. The first blade portion and the second blade portion are rotatably movable relative to the base blade between extended and retracted positions. Each blade portion includes a selectably removable first pin and a selectably removable second pin. When installed, the first pin secures each of the first blade portion and the second blade portion in the extended position and the retracted position relative to the base blade, and when installed, the second pin secures each of the first blade portion and the second blade portion in the extended position relative to the base blade.

18 Claims, 8 Drawing Sheets

(56) References Cited

U.S. PATENT DOCUMENTS

| | | | | |
|---|---|---|---|---|
| 7,805,862 | B2 | 10/2010 | Osgood et al. | |
| 7,805,866 | B1 * | 10/2010 | Osgood | 37/444 |
| 7,918,042 | B2 * | 4/2011 | Ropog | 37/281 |
| 2002/0194752 | A1 | 12/2002 | Guinard | |
| 2005/0126052 | A1 | 6/2005 | Ono et al. | |
| 2007/0068048 | A1 | 3/2007 | Ishihama et al. | |

FOREIGN PATENT DOCUMENTS

| | | |
|---|---|---|
| JP | 2003013465 | 1/2003 |
| JP | 2003206549 | 7/2003 |
| JP | 2006103627 | 4/2006 |

* cited by examiner

BULLDOZER FOLDING BLADE

FIELD OF THE INVENTION

This invention relates generally to a bulldozer including a pushing blade, and, more particularly, to a bulldozer including a pushing blade having an adjustable length between an extended or working position and a retracted or transport position.

BACKGROUND OF THE INVENTION

Historically, bulldozers have pushing blades that are of unitary or single piece construction. Consequently, bulldozer having pushing blades larger than a predetermined length require a special permit to transport on public roads, also referred to as an "oversize load" permit, unless the pushing blade is removed, which is highly undesirable and/or unfeasible.

Thus, what has been sought is a bulldozer blade having folding portions that is easily manually converted from an extended or working position to a retracted or transport position.

SUMMARY OF THE INVENTION

The present invention relates to a bulldozer having a folding blade including a base blade having opposed ends. A first blade portion is rotatably movable about an axis near one end of the base blade. A second blade portion is rotatably movable about an axis near an end of the base blade opposite the first blade portion. The first blade portion and the second blade portion are rotatably movable relative to the base blade between an extended position and a retracted position. Each Blade portion includes a selectably removable first pin and a selectably removable second pin. When installed, the first pin secures each of the first blade portion and the second blade portion in the extended position and the retracted position relative to the base blade, and when installed, the second pin secures each of the first blade portion and the second blade portion in the extended position relative to the base blade.

The present invention further relates to a folding blade for a bulldozer including a base blade having opposed ends. A first blade portion is rotatably movable about an axis near one end of the base blade. A second blade portion is rotatably movable about an axis near an end of the base blade opposite the first blade portion. The first blade portion and the second blade portion are rotatably movable relative to the base blade between an extended position and a retracted position. Each blade portion includes a selectably removable first pin and a selectably removable second pin. When installed, the first pin secures each of the first blade portion and the second blade portion in the extended position and the retracted position relative to the base blade, and when installed, the second pin secures each of the first blade portion and the second blade portion in the extended position relative to the base blade.

The present invention further relates to a method for folding a bulldozer blade including providing a base blade having opposed ends. A first blade portion is rotatably movable about an axis near one end of the base blade. A second blade portion is rotatably movable about an axis near an end of the base blade opposite the first blade portion. The first blade portion and the second blade portion are rotatably movable relative to the base blade between an extended position and a retracted position. Each blade portion includes a selectably removable first pin and a selectably removable second pin. The method further includes removing the first pins and the second pins from the opposed ends of the base blade. The method further includes rotating the first blade portion and the second blade portion relative to the base blade to a position corresponding to one of the extended position and the retracted position one of the opposed ends of the base blade. When installed, the method further includes the first pin securing each of the first blade portion and the second blade portion in the extended position and the retracted position relative to the base blade, and when installed, the second pin securing each of the first blade portion and the second blade portion in the extended position relative to the base blade.

An advantage of the present invention is the capability to manually convert the pushing blade from an extended or working position to a retracted or transport position.

A further advantage of the present invention is a pushing blade having no additional structural components when the blade is in an extended or working position or in a retracted or transport position.

In one embodiment, the present invention provides one or more of the above-mentioned advantages.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
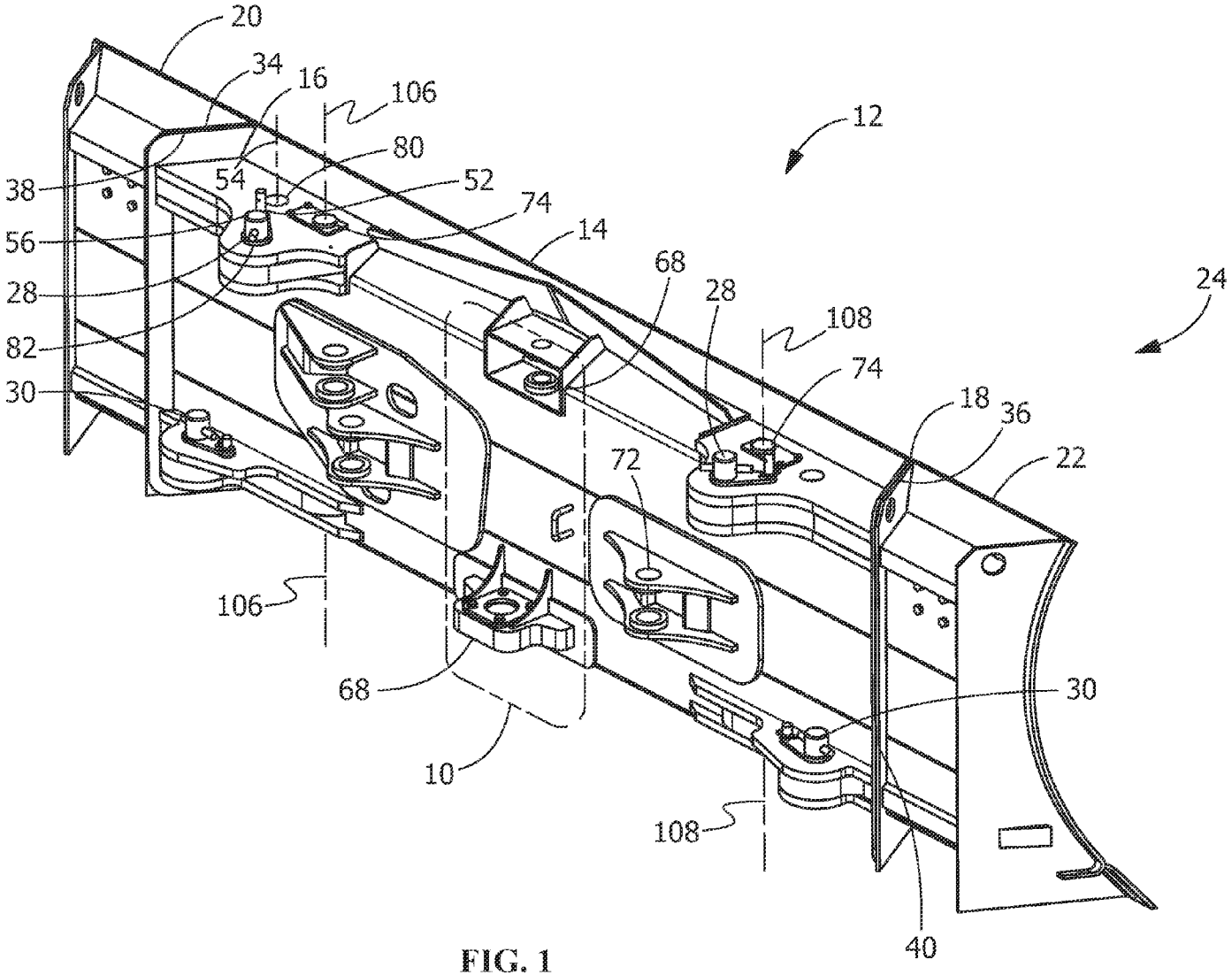
FIG. 1 is an upper perspective view of an exemplary folding bulldozer blade in an extended position.
Figure 2:
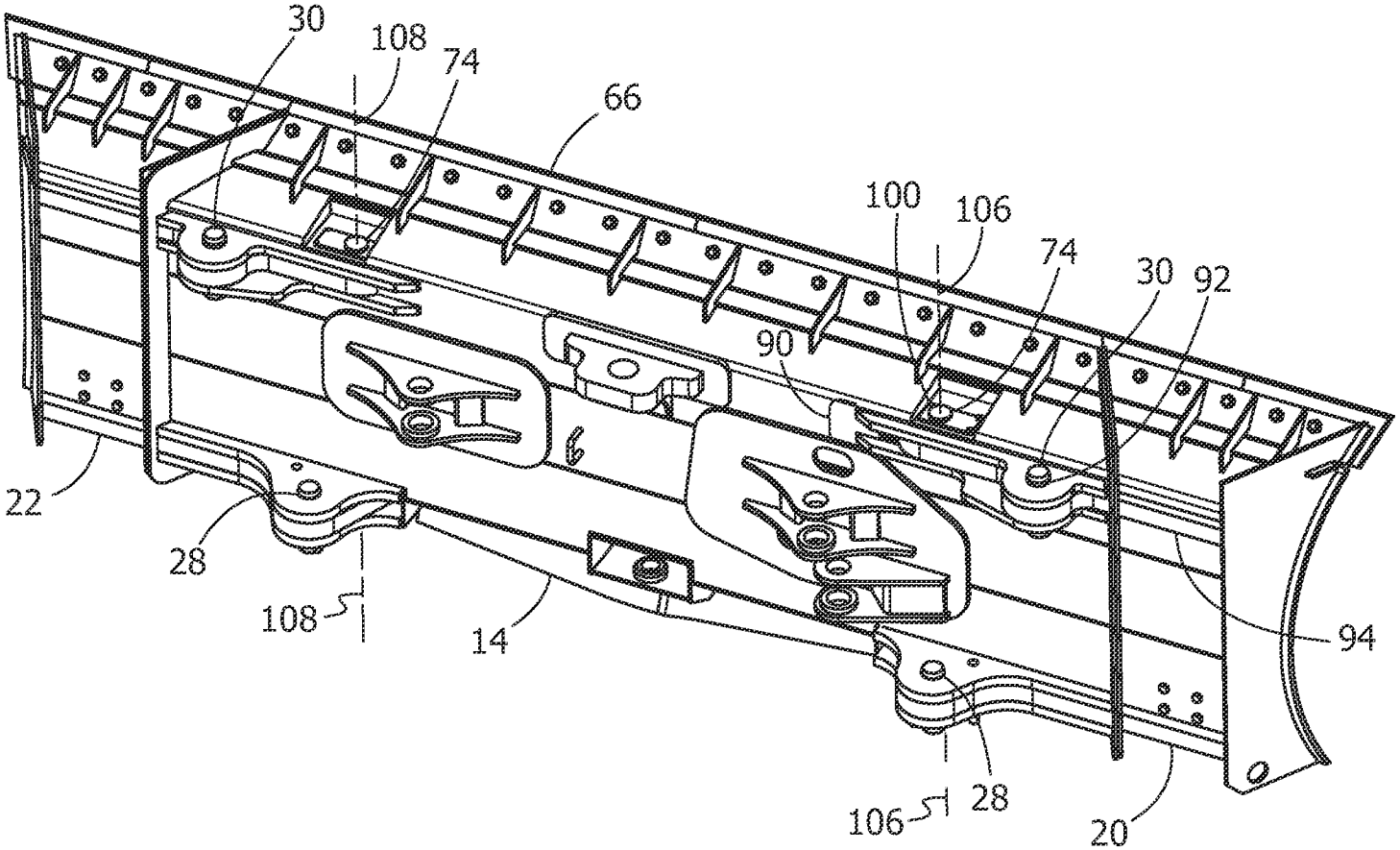
FIG. 2 is an inverted upwardly looking perspective view of the bulldozer blade of FIG. 1.

Referring now to the drawings, FIG. 1 shows a folding blade 12 for a bulldozer 10 in a working or extended position 24. Folding blade 12 includes a base blade 14 having opposed ends 16, 18 and attachment points 68, 70, 72 for securing and manipulating the orientation of folding blade 12 by bulldozer 10. In extended position 24, a surface 34 corresponding to end 16 of base blade 14 abuts a surface 38 of a first blade portion 20. First blade portion 20 is rotatably movable about an axis 106 (FIGS. 1, 2) near end 16 of base blade 14. Similarly, in extended position 24, a surface 36 corresponding to end 18 of base blade 14 abuts a surface 40 of a second blade portion 22. Second blade portion 22 is rotatably movable about axis 108 (FIGS. 1, 2) near end 16 of base blade 14. As will be discussed in further detail below, by rotatably moving first blade portion 20 and second blade portion 22 relative to base blade 14 of folding blade 12 from extended position 24 (FIG. 3) to retracted position 26 (FIG. 6), the collective length of folding blade 12 is reduced from an extended length 33 (FIG. 3) of extended position 24 to an effective length or length 32 of base blade 14 corresponding to retracted position 26 (FIG. 6), permitting bulldozer 10 to be transported over public roads without requiring a special permit or designation signage similarly requiring, commonly referred to as an "oversize load". That is, a vehicle or cargo, such as a bulldozer being transported on a trailer, which bulldozer blade length exceeding predetermined legal dimensions, usually requires a special permit which requires extra fees to be paid in order for the oversize vehicle to legally travel on the roadways. The permit usually specifies a route the load must follow as well as the dates and times during which the load may travel. Typically, the edges of any oversize load must be marked, such as by colored flags, and may additionally require flashing lights to make them visible to drivers. Also, the hauling vehicle must typically have at least one flashing amber light in the front and back. Additionally, pilot and trailing cars are typically required to warn drivers about the traveling oversize load.

Figure 6:
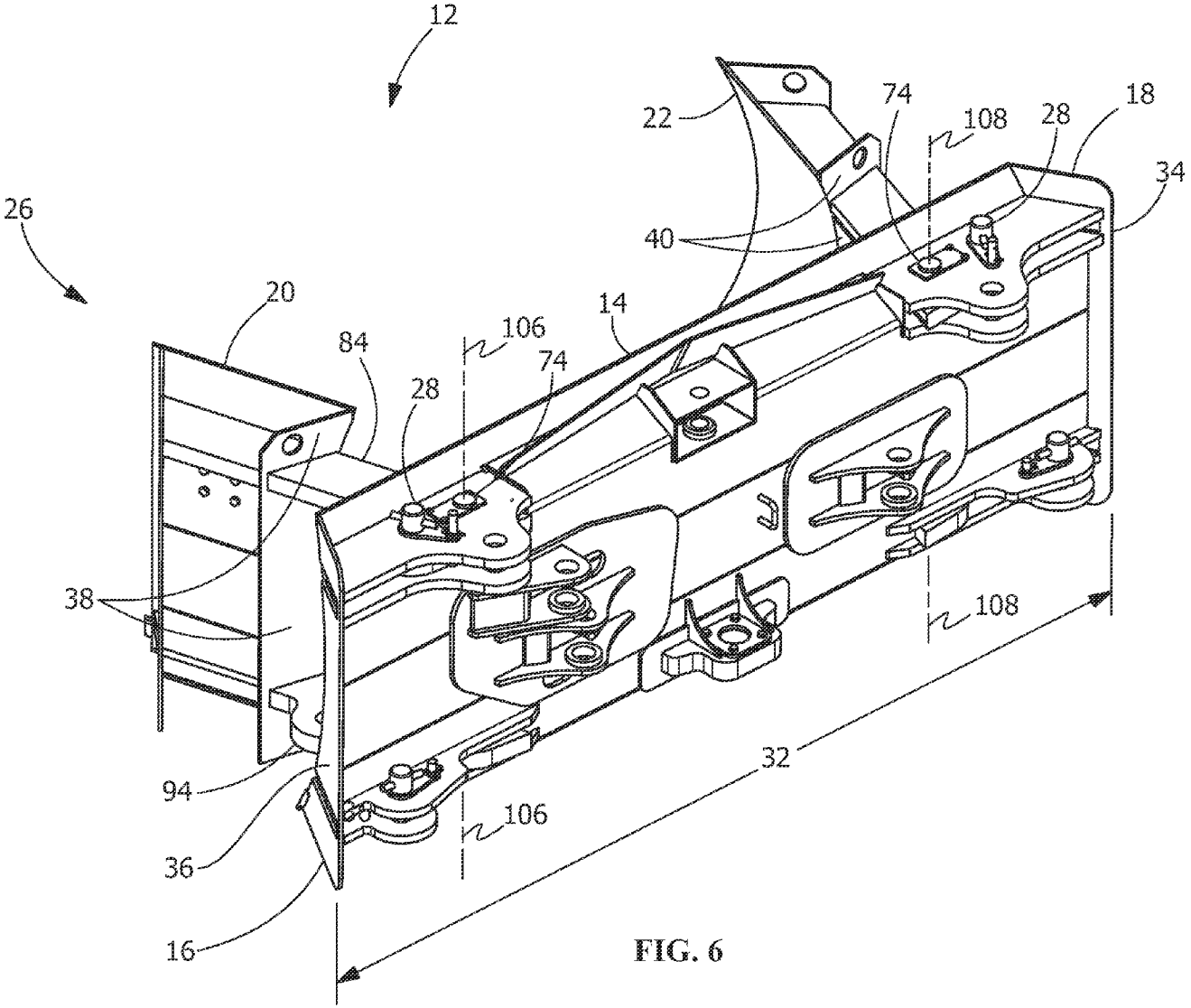
FIG. 6 is an upper perspective view of an exemplary folding bulldozer blade in a retracted position.
Figure 7:
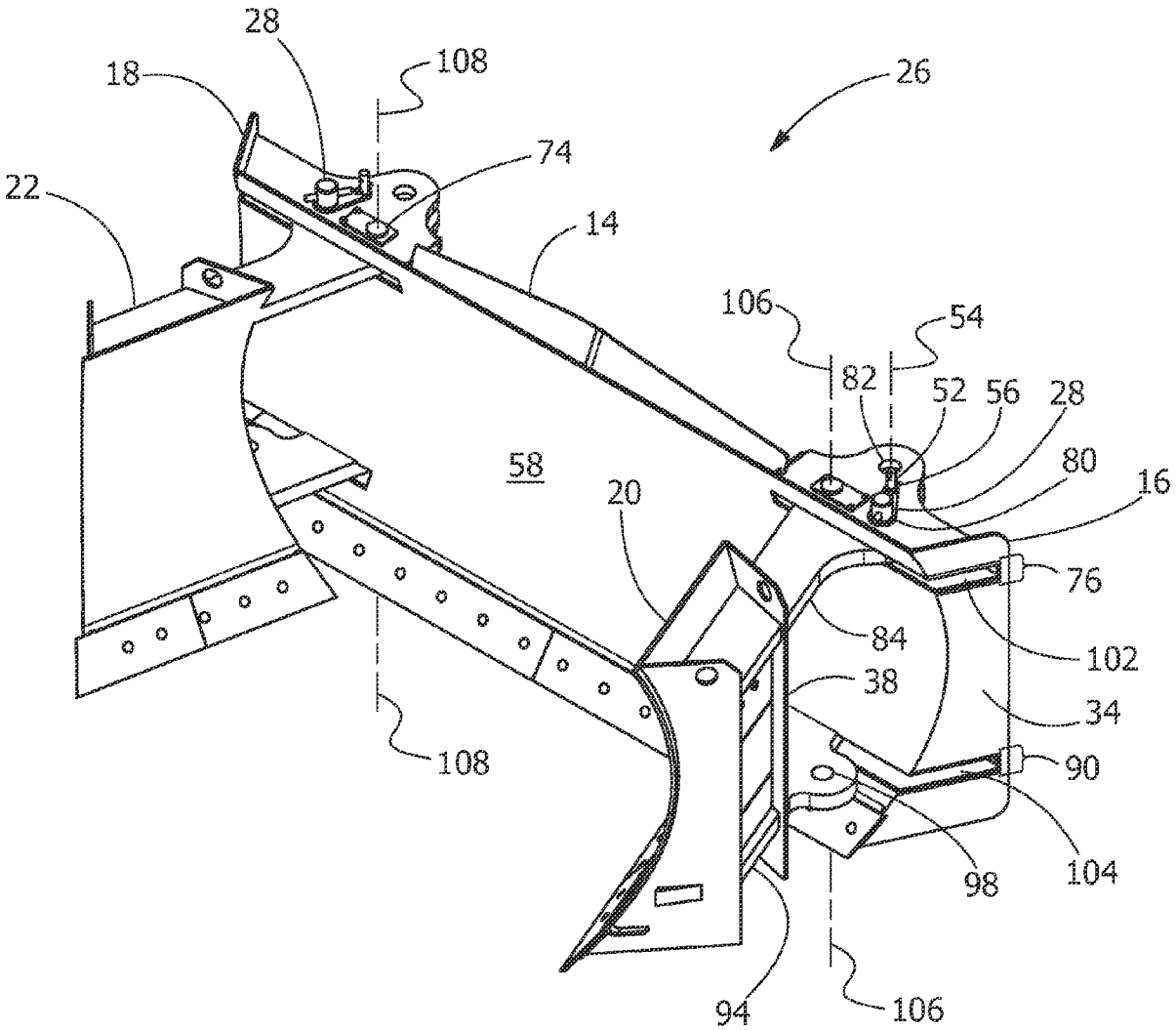
FIG. 7 is a reverse upper perspective view of the folding bulldozer blade of FIG. 6.

As shown collectively in FIGS. 1, 6 and 7, the abutting surfaces 38, 40 of respective first blade portion 20 and the second blade portion 22 define a substantial proportion of a total surface area of the corresponding ends 16, 18 of respective first blade portion 20 and second blade portion 22, the abutting surfaces 38, 40 providing structural support for the first blade portion 20 and the second blade portion 22 relative to the corresponding base blade 14 facing surfaces 34, 36 when first blade portion 20 and second blade portion 22 are in extended position 24 that is configured to be operated to push material by the bulldozer.

As shown collectively in FIGS. 1, 6 and 7, first and second pivot arms 84, 94 extend from the abutting surfaces 38, 40 of each of respective first blade portion 20 and second blade portion 22 such that upon first blade portion 20 and second blade portion 22 being rotated relative to the base blade 14 about corresponding axes 106, 108 toward retracted position 26, the abutting surfaces 38, 40 of first blade portion 20, second blade portion 22 and base blade 14 are separated by the arc defined by upper pivot arms 84 and lower pivot arms 94 rotating about corresponding axes 106, 108.

FIGS. 3, 4, 6 and 7 collectively show the operation of first blade portion 20 of folding blade 12 that is rotatably movable about axis 106 near end 16 of base blade 14 between a working or an extended position 24 and a transport or retracted position 26. Since second blade portion 22 of folding blade 12 operates in a manner similar to that of first blade portion 20, only first blade portion 20 will be discussed in detail. Base blade 14 includes an upper plate pair 76, which plates of upper plate pair 76 are separated from each other and correspond to a slot 102 formed in base blade 14. Collectively, slot 102 and upper plate pair 76 are configured and sized to receive an upper pivot arm 84 extending from first blade portion 20. Base blade 14 also includes a lower plate pair 90, which plates of lower plate pair 90 are separated from each other and correspond to a slot 104 formed in base blade 14. Collectively, slot 104 and lower plate pair 90 are configured and sized to receive a lower pivot arm 94 extending from first blade portion 20. Upper plate pair 76 includes an aligned pair of pivot openings 78, an aligned pair of openings 80 and an aligned pair of openings 82 collectively formed therethrough. Lower plate pair 90 includes a pair of aligned pivot openings 92 formed therethrough.

As further shown in FIGS. 3, 4, 6 and 7, upper pivot arm 84 of first blade portion 20 is received by slot 102 and upper plate pair 76 of base blade 14, and lower pivot arm 94 of first blade portion 20 is received by slot 104 and lower plate pair 90 of base blade 14. Once pivot arms 84, 94 have been received by their respective plate pair 76, 90, a pair of hinge pins 74 are installed to pivotably secure first blade portion 20 and base blade 14 about an axis 106. That is, once aligned pivot openings 78 of upper plate pair 76 and aperture 86 of upper pivot arm 84 are mutually aligned, hinge pin 74 is collectively inserted therethrough and installed. Similarly, once aligned pivot openings 100 (FIG. 2) of lower plate pair 90 and aperture 96 (FIG. 4) of lower pivot arm 94 are mutually aligned, hinge pin 74 is collectively inserted therethrough and installed. In other words, upon installation of hinge pin 74, first blade portion 20 is rotatably movable about axis 106 positioned near end 16 of base blade 14. In a similar manner, upon installation of hinge pins 74, second blade portion 22 is rotatably movable about an axis 108 positioned near end 16 of base blade 14.

As yet further shown in FIGS. 3, 4, 5, 6 and 7, first blade portion 20 can be secured in working or extended position 24 upon mutual alignment of aligned openings 82 of upper plate pair 76 and aperture 88 of upper pivot arm 84 followed by insertion of a shaft 42 of first pin 28 therethrough. Such mutual alignment is achieved by rotation of first blade portion 20 about axis 106 relative to base blade 14. Similarly, first blade portion 20 can be further secured in working or extended position 24, upon mutual alignment of aligned openings 92 of lower plate pair 90 and aperture 98 of lower pivot arm 94 followed by insertion of a shaft 42 of second pin 30 therethrough.

Figures 4, 5:
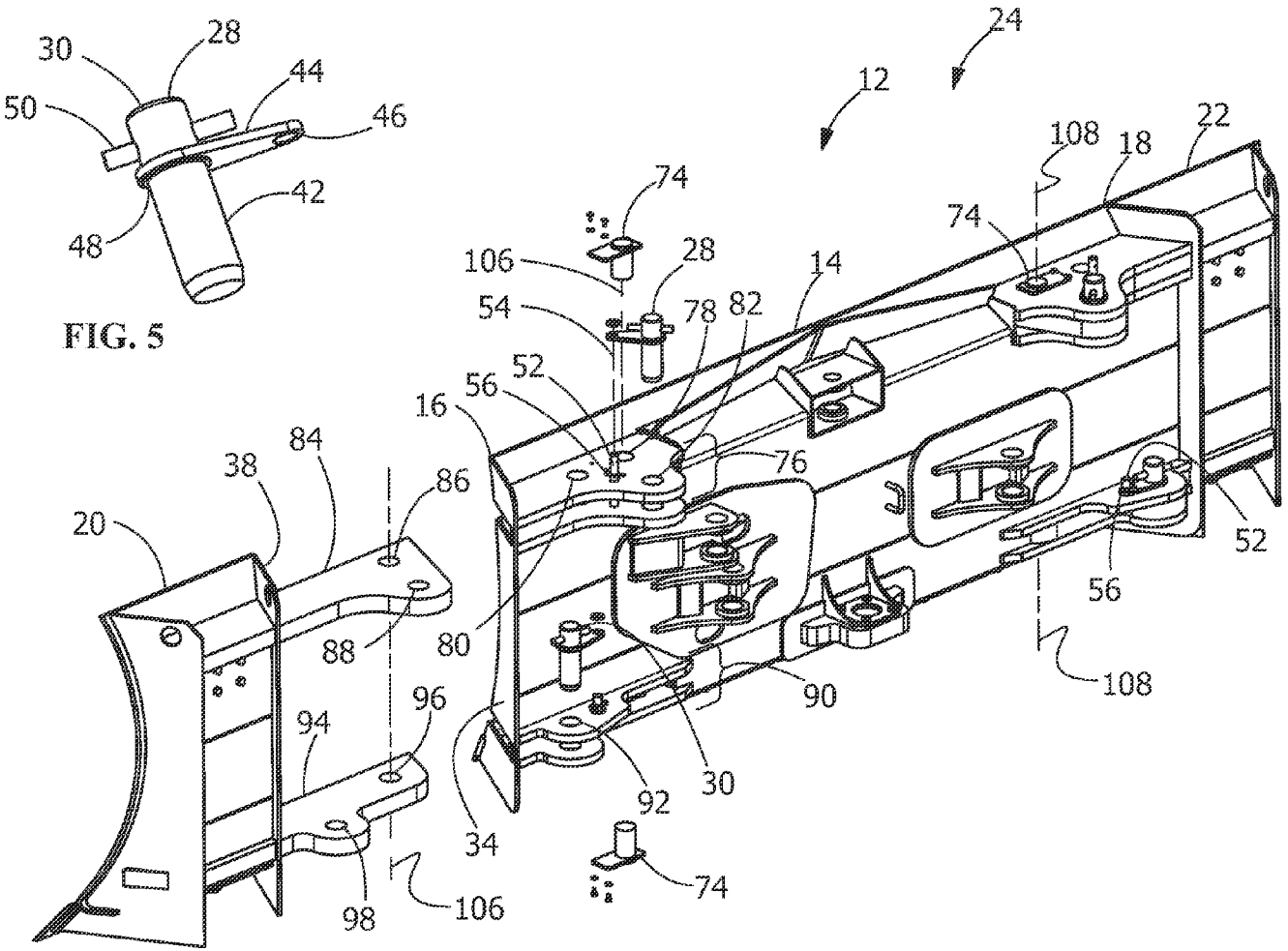
FIG. 4 is a partially exploded upper perspective view of an exemplary folding bulldozer blade.
FIG. 5 is a lower perspective view of an exemplary pin usable with the folding bulldozer blade.

As shown in FIG. 5, first pin 28 and second pin 30 are identical. In another embodiment, first pin 28 in second pin 30 may include different components, if desired.

As yet further shown in FIGS. 3, 4, 5, 6 and 7, first blade portion 20 can be rotatably moved about axis 106 from working or extended position 24 to transport or retracted position 26. If the first blade portion 20 is fully secured in working or extended position 24 (i.e., both first pin 28 and second pin 30 are installed in corresponding openings 82, 92 of respective upper plate pair 76 and lower plate pair 90), first pin 28 is removed from aligned openings 82 of upper plate pair 76 and second pin 30 is removed from aligned openings 92 of lower plate pair 90. Upon removal of first and second pins 28, 30 from corresponding aligned openings 82, 92 of respective upper plate pair 76 and lower plate pair 90, first blade portion 20 is then rotated about axis 106 from the working or extended position 24 toward transport or retracted position 26. Once first blade portion 20 has been rotated to transport or retracted position 26, in which aligned openings 80 of upper plate pair 76 and aperture 88 of upper pivot arm 84 are in mutual alignment, first pin 28 is reinstalled therethrough. In addition, second pin 30 is reinstalled in aligned openings 92 of lower plate pair 90. However, when first blade portion 20 is positioned in transport or retracted position 26, lower pivot arm 94 lacks a corresponding opening that is mutually aligned with aligned openings 92 of lower plate pair 90. In other words, as sufficiently shown in the partially exploded portion of FIG. 4, it is appreciated by one having ordinary skill in the art that second pin 30 is not required to help secure first blade portion 20 in transport or refracted position 26, but is reinstalled in aligned openings 92 of lower plate pair 90 to prevent inadvertent loss or misplacement of second pin 30. In another embodiment, the lower pivot arm 94 can be configured to add an aperture formed therethrough that would align with aligned openings 92 of lower plate pair 90 to receive second pin 30 when first blade portion 20 is in the working or extended position 26, if desired.

It is to be understood that folding blade 12 is essentially comprised of base blade 14, first blade portion 20, second blade portion 22, hinge pins 74 and first and second pins 28, 30, with rotational movement of the blade portions 20, 22 relative to base blade 14 and secured by pins 28, 30 in the respective extended/retracted positions 24, 26. That is, no special components are associated only with one of the extended position 24 or retracted position 26. Stated another way, no structural components are installed or removed when folding blade 12 is in extended position 24 versus when folding blade 12 is in retracted position 26.

It is appreciated that first blade portion 20 can be rotatably moved about axis 106 from transport or retracted position 26 to working or extended position 24 by reversing the sequence of actions previously described.

Figure 3:
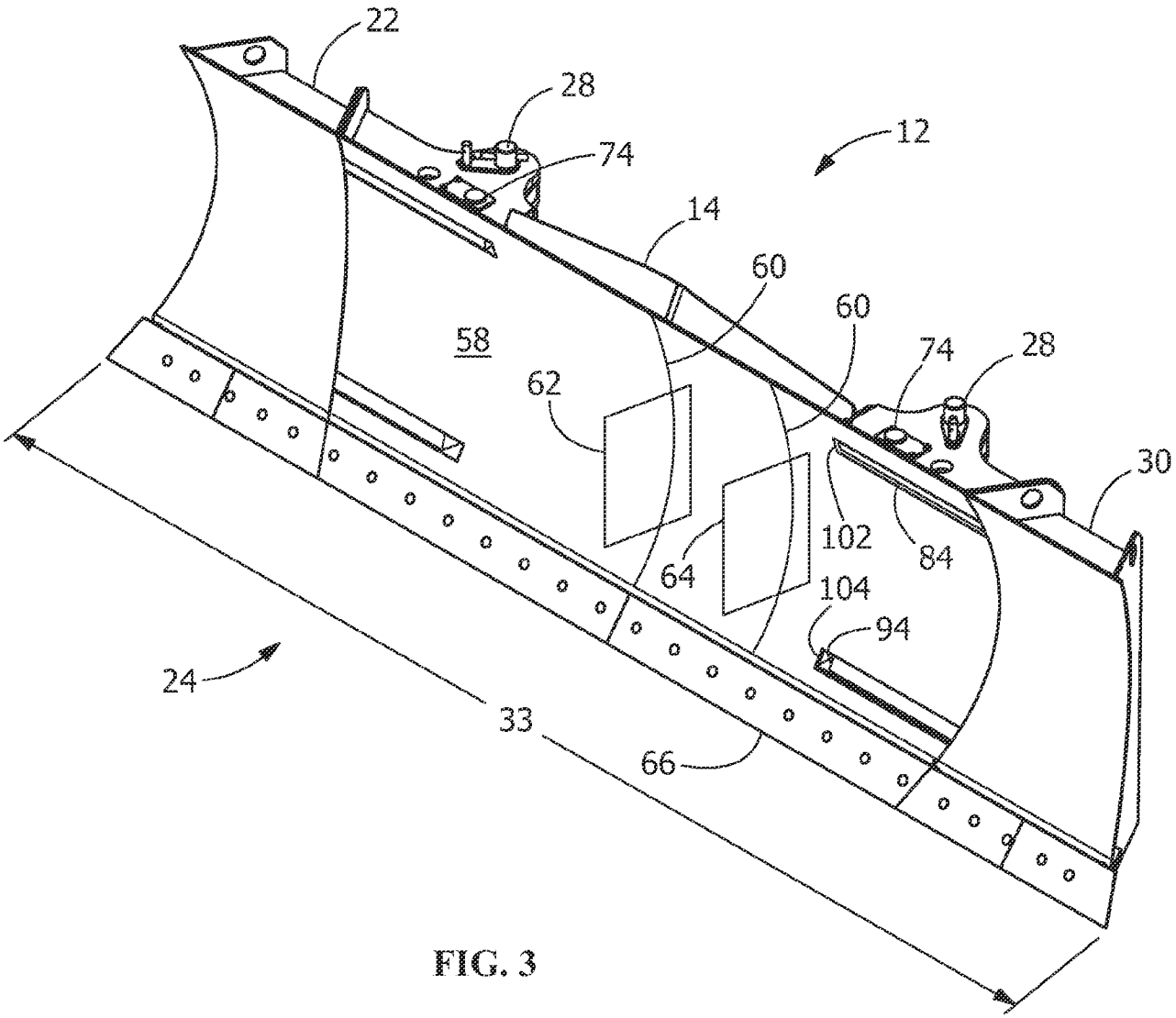
FIG. 3 is a reverse upper perspective view of the bulldozer blade of FIG. 1.

As shown in FIG. 3, in extended position 24, base blade 14, first blade portion 20 and second blade portion 22 of folding blade 12 form a continuous working surface 58. As further shown in FIG. 3, working surface 58 has a profile 60 formed in base blade 14. As yet further shown in FIG. 3, profile 60 of the working surface 58 of the base blade 14, the first blade portion 20 and the second blade portion 22 in the extended position 24 are substantially identical as defined by an intersection formed between a central plane 62 bisecting and perpendicular to a cutting/scraping edge 66 of the base blade 14 of folding blade 12 and the work surface 58. In a similar manner, corresponding intersections between working surface 58 and planes parallel to central plane 62, such as plane 64 define other substantially identical profiles 60.

As shown in FIGS. 5 and 8-11, an exemplary method of installation and removal of first pin 28 relative to base blade 14 of folding blade 12 is now discussed. In one embodiment, first pin 28 and second pin 30 are identical. In one embodiment, first pin 28 includes shaft 42 to which a flange plate 44 that is substantially perpendicular to shaft 42 is secured. Flange plate 44 includes an opening 46 formed therethrough for receiving a protrusion 52 having an axis 54 that extends outwardly from base blade 14. A retention feature 56 such as a cotter pin or ball-lock pin or the like is operatively connected to protrusion 52 to prevent inadvertent removal of first pin 28 from protrusion 52. A handle 50 extends outwardly from shaft 42. As shown in FIG. 5, shoulder 48 is formed on flange plate 44 facing away from handle 50, providing a gap that would not otherwise exist between the surface of flange plate 44 facing shoulder 48 and a mutually flat and parallel surface facing flange plate 44 when first pin 28 is installed. The resulting gap permits insertion of a tool (not shown), such as a blade screwdriver head to assist, if necessary, for removal of first pin 28.

Figure 8:
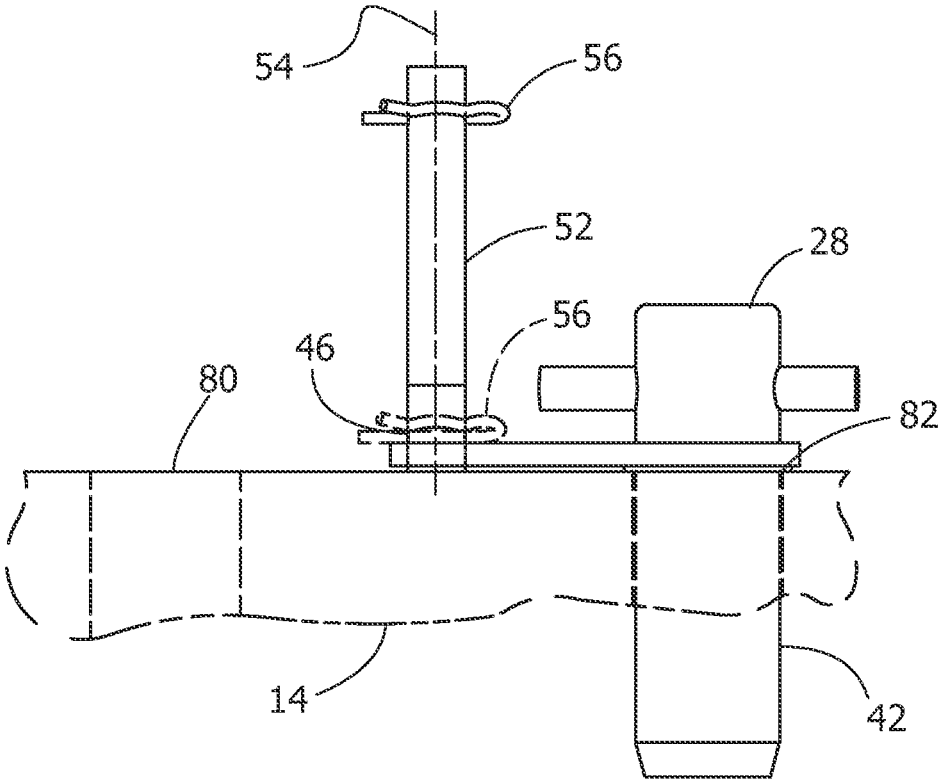
FIGS. 8-11 are exemplary steps in the installation/removal of a pin relative to an exemplary folding bulldozer blade.

As further shown sequentially in FIGS. 8-11, shaft 42 of first pin 28 is shown in FIG. 8 installed in aligned openings 82 (only one aligned opening 82 is shown in FIGS. 8-11) such as to secure first blade portion 20 in extended position 24 (FIG. 4). As shown in FIGS. 8-11, opening 46 of first pin 28 is slidably received by protrusion 52 and secured by retention feature 56. In one embodiment, retention feature 56 can be positioned near an end of protrusion 52 that is distal from base blade 14. In another embodiment, retention feature 56 can be positioned as shown in phantom line in FIG. 8, in which retention feature 56 is positioned in close proximity to base blade 14. It is to be understood that in order to install/remove first pin 28 from an installed position in base blade 14, retention feature 56 should be removed from portion 52 or moved to the position near the end of protrusion 52 is distal from base blade 14.

Figure 9:
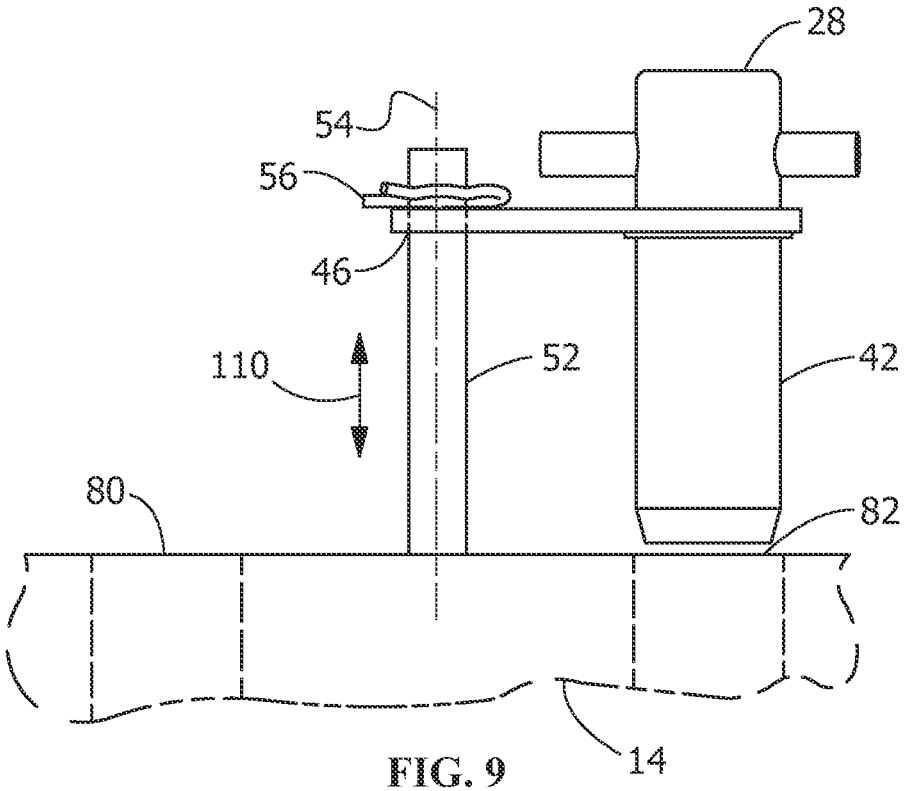
Figure 10:
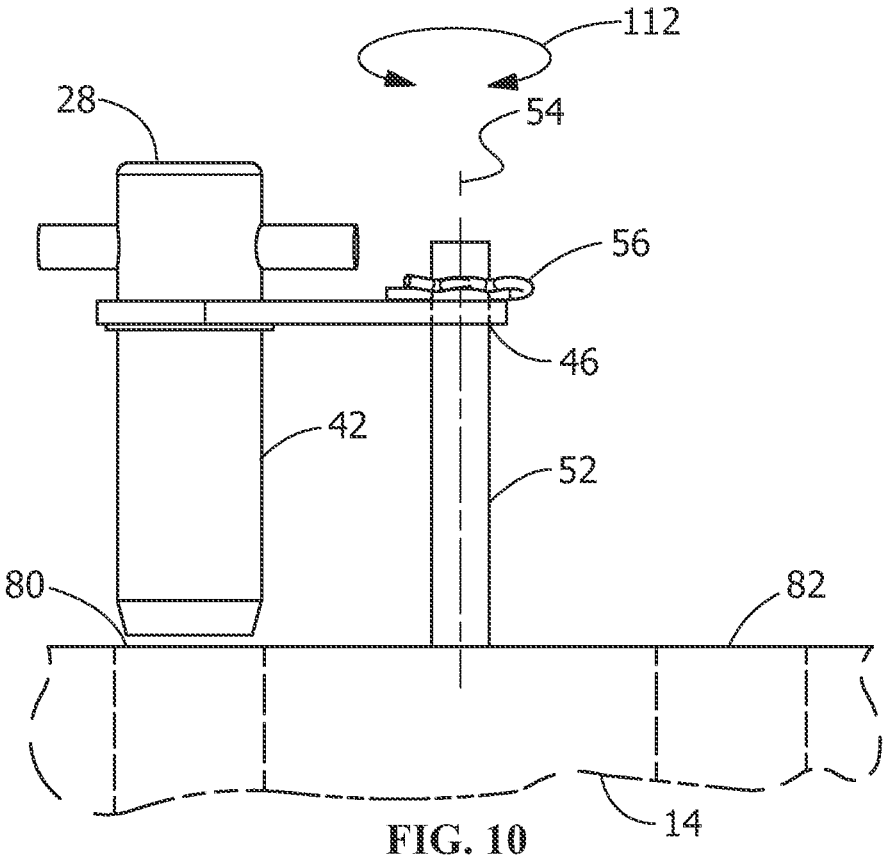
Figure 11:
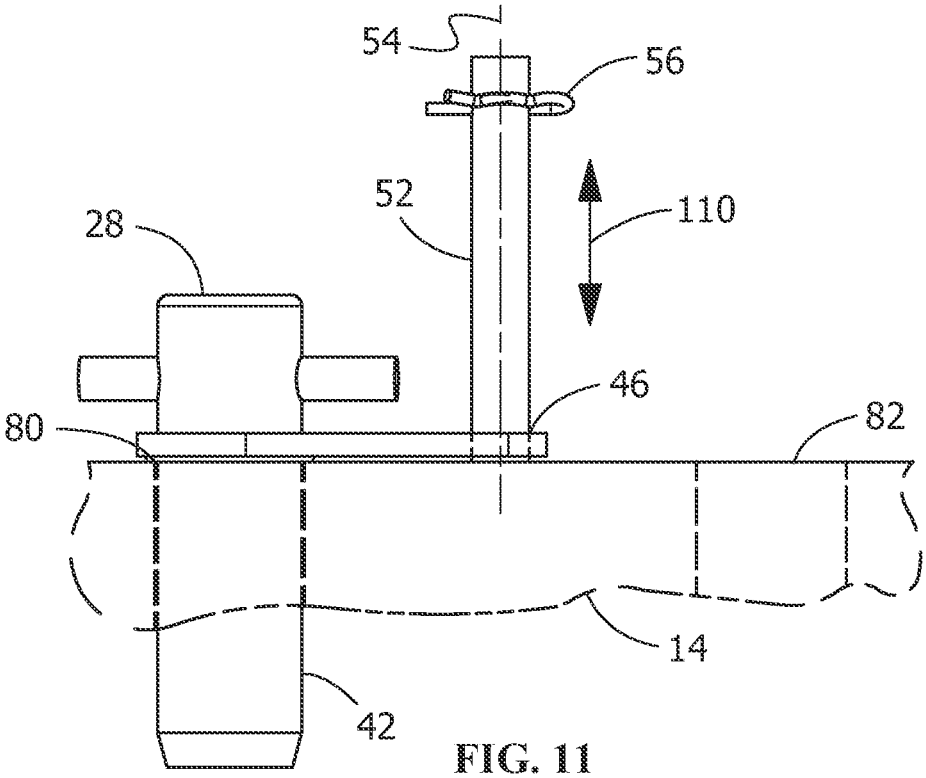

As shown in FIG. 9, when retention feature 56 is positioned near the end of protrusion 52 that is distal from base blade 14, opening 46 of first pin 28 is urged into axial movement 110 in a direction away from base blade 14 until shaft 42 of first pin 28 is removed from aligned openings 82. At this point, first blade portion 20 is rotatably moved from extended position 24 to retracted position 26 as previously discussed. Once first blade portion 20 has been rotatably moved to retracted position 26, installation of first pin 28 as shown in FIGS. 10 and 11 are discussed. As shown in FIG. 10, once shaft 42 of first pin 28 has been removed from aligned openings 82, first pin 28 is urged into rotational movement 112 about axis 54 of protrusion 52 until shaft 42 is aligned with aligned openings 80 (only one aligned opening 80 is shown in FIGS. 8-11). As shown in FIG. 11, once shaft 42 has been aligned with aligned openings 80, opening 46 of first pin 28 is urged into axial movement 110 along axis 54 of protrusion 52 in a direction toward base blade 14 until shaft 42 of first pin 28 is fully engaged or installed in aligned openings 80. In this embodiment, first pin 28 can be selectably removed/installed for securing base blade 14 between either of extended position 24 or retracted position 26 in a manner such that first pin 28 is continually captured (i.e., prevented from inadvertent loss or misplacement).

Stated another way, upon removal of first pin 28 from base blade 14 when one of the corresponding first blade portion 20 and the second blade portion 22 of folding blade 12 is positioned in one of the extended position 24 and the retracted position 26, the first pin opening 46 remains engaged with the protrusion 52, the pin opening 46 being rotatably movable about axis 54 of protrusion 52 and alignable for installation in base blade 14 when one of the corresponding first blade portion 20 and the second blade portion 22 of the folding blade 12 is positioned in the other one of the extended position 24 and the retracted position 26.

In light of all the foregoing, it should thus be apparent to those skilled in the art that there has been shown and described a folding bulldozer blade. However, it should also be apparent that, within the principles and scope of the invention, many changes are possible and contemplated, including in the details, materials, steps, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A bulldozer comprising:

a folding blade comprising:

a base blade having opposed ends;

a first blade portion rotatably movable about an axis near one end of the base blade;

a second blade portion rotatably movable about an axis near an end of the base blade opposite the first blade portion;

the first blade portion and the second blade portion rotatably movable relative to the base blade between an extended position and a retracted position;

each blade portion including at least one selectably removable pin;

wherein when installed when the blade portions are in the extended position, the respective pins secure each of the first blade portion and the second blade portion in the extended position generally aligning working surfaces of the first and second portions and base blade and when the respective pins are installed when the blade portions are in the retracted position the respective pins secure the distal ends of the first and second blades in a rotated position that is both forward and inward of the ends of the base blade wherein corresponding ends of the base blade and the first blade portion and the second blade portion have facing surfaces that abut each other in the extended position; and wherein abutting surfaces of the first blade portion and the second blade portion are oriented at an angle extending outward and rearward from the working surface and define a majority of a total surface area of the corresponding ends of the first blade portion and the second blade portion, the abutting surfaces providing structural support for the first blade portion and the second blade portion relative to the corresponding base blade facing surfaces when the first blade portion and the second blade portion are in the extended position and operated to push material by the bulldozer.

2. The bulldozer of claim 1, wherein a length of the folding blade in the retracted position is less than a predetermined distance corresponding to an oversize load.

3. The bulldozer of claim 1, wherein first and second pivot arms extend rigidly from the abutting surfaces of each of the first blade portion and the second blade portion such that upon the first blade portion and the second blade portion being rotated relative to the base blade about corresponding axes toward the retracted position, the abutting surfaces of the first blade portion, the second blade portion and the base blade are separated by an arc defined by the first pivot arms and the second pivot arms.

4. The bulldozer of claim 1, wherein the at least one selectably removable pin comprises a first pin and a second pin;

wherein the respective first pins are configured to secure the first blade portion and the second blade portion in the extended position and in a different configuration to secure first and second blade portions in the retracted position relative to the base blade, and when installed, the second pin also secures each of the first blade portion and the second blade portion in the extended position relative to the base blade;

the first pins and the second pins each comprise a shaft secured to a flange plate substantially perpendicular to the shaft, the flange plate having an opening, wherein a protrusion is received through the opening during installation of the first pins and the second pins in the folding blade, the protrusion having an axis and extending from the base blade.

5. The bulldozer of claim 4, wherein the protrusion includes a retention feature to prevent inadvertent disengagement between the first pins openings and the second pins openings and the corresponding protrusion.

6. The bulldozer of claim 4, wherein upon removal of the first pin from the base blade when one of the corresponding first blade portion and the second blade portion of the folding blade is positioned in one of the extended position and the retracted position, the first pin opening remains engaged with the protrusion, the pin opening being rotatably movable about the axis of the protrusion and alignable for installation in the base blade when one of the corresponding first blade portion and the second blade portion of the folding blade is positioned in the other one of the extended position and the retracted position.

7. The bulldozer of claim 1, wherein the first and second portions and base blade forms a continuous working surface in the extended position.

8. The bulldozer of claim 7, wherein a profile of the working surface of the base blade, the first blade portion and the second blade portion in the extended position are substantially identical as defined by an intersection formed between a central plane bisecting and perpendicular to a cutting/scraping edge of the base blade and the working surface, and corresponding intersections between the working surface and planes parallel to the central plane.

9. A folding blade for a bulldozer comprising:

a base blade having opposed ends;

at least one side blade portion rotatably movable about an axis near one end of the base blade;

the at least one side blade portion rotatably movable relative to the base blade between an extended position and a retracted position;

the at least one side blade portion including at least one selectably removable pin;

wherein when installed in one configuration, the at least one pin secures the at least one blade portion in the extended position and in another configuration the at least one in secures the at least one blade portion in the retracted position relative to the base blade; and wherein the end of the base blade and the at least one blade portion have facing surfaces that abut each other in the extended position; and wherein in the extended position the at least one blade portion is oriented in a direction angled from the working surfaces and define a majority proportion of a total surface area of the corresponding end of the at least one blade portion, the abutting facing surfaces providing structural support for the at least one blade portion relative to the corresponding base blade facing surface when the at least one blade portion is in the extended position and operated to push material by the bulldozer;

wherein first and second pivot arms extend from the abutting surfaces of each of the at least one blade portion such that the at least one blade portion is rotatable relative to the base blade about an axes toward the retracted position, the abutting surfaces of the at least one blade portion, and the base blade are separated by an arc defined by the first pivot arms and the second pivot arms.

10. The blade of claim 9, the at least one side blade comprises a first blade portion and a second blade portion, and the at least one pin comprises respective first and second pins corresponding to the blade portions, the first blade portion rotatably movable about an axis near one end of the base blade;

a second blade portion rotatably movable about an axis near an end of the base blade opposite the first blade portion;

the first blade portion and the second blade portion rotatably movable relative to the base blade between the extended position and the retracted position and when installed, the second pins secures each of the first blade portion and the second blade portion in the extended position relative to the base blade.

11. The blade of claim 9, wherein the abutting surfaces are shaped to extend outward and rearward from the working surface.

12. The blade of claim 9, wherein the first and second pivot arms are at least partially located within recesses in the base blade when in the extended position.

13. The blade of claim 9, wherein the at least one pin comprises a first pin and a second pin, each pin comprises a shaft secured to a flange plate substantially perpendicular to the shaft, the flange plate having an opening and a protrusion therein during installation of the first pin and the second pin in the folding blade, the protrusion having an axis and extending from the base blade.

14. The blade of claim 13, wherein the protrusion includes a retention feature to prevent inadvertent disengagement between the first pin opening and the second pin opening and the corresponding protrusion.

15. The blade of claim 13, wherein upon removal of the first pin from the base blade when one of the corresponding first blade portion and the second blade portion of the folding blade is positioned in one of the extended position and the retracted position, the first pin opening remains engaged with the protrusion, the pin opening being rotatably movable about an axis of the protrusion and alignable for installation in the base blade when one of the corresponding first blade portion and the second blade portion of the folding blade is positioned in the other one of the extended position and the retracted position.

16. The blade of claim 9, wherein the folding blade forms a continuous working surface in the extended position, and a profile of the working surface of the base blade, the first blade portion and the second blade portion in the extended position are substantially identical as defined by an intersection formed between a central plane bisecting and perpendicular to a cutting/scraping edge of the base blade and the work surface, and corresponding intersections between the working surface and planes parallel to the central plane.

17. A method for folding a bulldozer blade comprising:

providing a base blade having opposed ends, a first blade portion rotatably movable about an axis near one end of the base blade, a second blade portion rotatably movable about an axis near an end of the base blade opposite the first blade portion, the first blade portion and the second blade portion rotatably movable relative to the base blade between an extended position and a retracted position; each blade portion including a selectably removable first pin and a selectably removable second pin;

removing at least one of installed first pins and second pins from the opposed ends of the base blade;

rotating the first blade portion and the second blade portion relative to the base blade from the extended position to the retracted position;

installing the second pins and securing the first and second blade portions in the retracted position wherein when installed, the respective first pins secure each of the first blade portion and the second blade portion in the extended position generally aligning working surfaces of the first and second portions and base blade; and wherein in the retracted position distal ends of the first and second blades are rotated inwardly forward of the base blade, and when installed, the second pins secure each of the first blade portion and the second blade portion in the extended position relative to the base blade.

18. The method of claim 17, wherein when installed the first pins are inserted within blade portion apertures for securing the position of the first and second blade portions with respect to the base blade and wherein the blade portion apertures are positioned such that in the extended position the blade portion apertures are rearward of the working surface of the base blade and in the retracted position the blade portion apertures are located forward of the working surface of the base blade.

* * * * *